US010638212B2

(12) United States Patent
Anderson

(10) Patent No.: US 10,638,212 B2
(45) Date of Patent: Apr. 28, 2020

(54) DUO HEADSET

(71) Applicant: Melody Anderson, Elk City, OK (US)

(72) Inventor: Melody Anderson, Elk City, OK (US)

( * ) Notice: Subject to any disclaimer, the term of this patent is extended or adjusted under 35 U.S.C. 154(b) by 0 days.

(21) Appl. No.: 16/280,751

(22) Filed: Feb. 20, 2019

(65) Prior Publication Data

US 2019/0273979 A1 Sep. 5, 2019

Related U.S. Application Data

(60) Provisional application No. 62/637,851, filed on Mar. 2, 2018.

(51) Int. Cl.

| | |
|---|---|
| ***H04R 25/00*** | (2006.01) |
| ***H04R 1/10*** | (2006.01) |
| ***H04R 3/12*** | (2006.01) |
| ***H01R 31/02*** | (2006.01) |

(52) U.S. Cl.

CPC ..... *H04R 1/1016* (2013.01); *H01R 31/02* (2013.01); *H04R 1/1033* (2013.01); *H04R 1/1041* (2013.01); *H04R 3/12* (2013.01); *H04R 2420/09* (2013.01); *H04R 2499/11* (2013.01)

(58) Field of Classification Search

CPC .... H01R 31/02; H04R 1/1016; H04R 1/1033; H04R 1/1041; H04R 2420/09; H04R 2499/11; H04R 3/12

USPC ..... 381/384

See application file for complete search history.

(56) References Cited

U.S. PATENT DOCUMENTS

| | | | |
|---|---|---|---|
| 9,191,730 | B2 | 11/2015 | Evans |
| 2008/0170740 | A1 | 7/2008 | Gantz |
| 2013/0016869 | A1 | 1/2013 | Winther |
| 2015/0086060 | A1 | 3/2015 | Russ |

*Primary Examiner* — Phylesha Dabney

(74) *Attorney, Agent, or Firm* — Integrity Patent Group, PLC; Michael C. Balaguy

(57) ABSTRACT

A personal listening apparatus is disclosed herein. The personal listening apparatus includes a housing, a main audio input, a splitter, a first headset, a second headset, and a first means for stowing the first headset. The personal listening apparatus allows a plurality of users to listen to an electronic device.

20 Claims, 7 Drawing Sheets

DUO HEADSET

CROSS REFERENCE TO RELATED APPLICATION

The present application is related to and claims priority to U.S. Provisional Patent Application No. 62/637,851 filed Mar. 2, 2018, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of headsets and more specifically relates to a stowable headset.

2. Description of Related Art

Stretching a single set of ear buds when sharing can result in damage to the ear buds. Users of single ear bud system are only able to hear half of the listening experience. For many, sharing ear buds with others is unpleasant and uncomfortable. Using a splitter is inconvenient because they tend to get lost and are difficult to locate when needed. A suitable solution is desired.

U.S. Pat/Pub. No. 9,191,730 to Brittany Evans relates to a two-in-one ear buds with a light-up cable. The described two-in-one ear buds with a light-up cable includes two sets of stereo ear buds that can be joined for a single person to use or separated so the stereo sound can be enjoyed by two people at the same time. The connecting cord is a flat cord with magnetic coupling that joins the cords together to reduce wiring that connects from the audio device to the ear buds. The cable joins a left and a right set of wiring and the ear buds are coupled to provide a single left and right or a pair of left and a pair or right separate ear buds. The cord has illumination LED elements that provide different color patterns to interact with the mp3. The lighting controller gives the user the option to turn the lights on and off with buttons on the controller.

BRIEF SUMMARY OF THE INVENTION

In view of the foregoing disadvantages inherent in the known headset art, the present disclosure provides a novel duo headset. The general purpose of the present disclosure, which will be described subsequently in greater detail, is to provide earphones configured to allow two people to listen to the same music and/or listening device.

A personal listening apparatus is disclosed herein. The personal listening apparatus includes a housing, a main audio input, a splitter, a first headset, a second headset, and a first means for stowing the first headset. The housing includes an outer-shell that defines an inner-cavity. The main audio input is fixed to the housing and configured to communicably couple with the electronic device and receive an audio signal from the electronic device. The splitter is fixed to the housing within the inner-cavity, and electronically coupled to the main line, the splitter configured to receive the audio signal from the main audio input and split the audio signal into a first audio output signal and a second audio output signal. The first headset including a first audio line and a first pair of earphones, the first audio line electronically coupled to the splitter, passing though the outer-shell, and configured to communicate the first audio output signal, the first pair of earphones electronically coupled to the first audio line and configured to convert the first audio output signal into a corresponding first sound. a second headset including a second audio line and a second pair of earphones, the second audio line electronically coupled to the splitter, passing though the outer-shell, and configured to communicate the second audio output signal, the second pair of earphones electronically coupled to the second audio line and configured to convert the second audio output signal into a corresponding second sound; and According to one embodiment, a method for a plurality of users to listen to an electronic device is also disclosed herein. The method includes the steps of providing the personal listening apparatus as above; a first user wearing the first headset; a second user wearing the second headset; communicably coupling the main audio input with the electronic device; listening to the first sound via the first headset; and listening to the second sound via the second headset.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a duo headset, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to headsets and more particularly to a duo headset as used to share listening to an electronic device.

Generally, disclosed is a twin headset which may include two sets of ear buds on one line that have the appearance of a conventional pair of earphones. The twin headset may offer an additional pair of ear buds that are retractable from a main line or zippered on the main line, allowing two people to listen to the same headset without plugging two sets of headsets into a splitter. The twin headset may be attached or otherwise coupled to one main line using a plastic housing, rubber seals and bud covers, electrical wiring, magnets, copper, and/or aluminum. The extra pair of ear buds may be retractable from the line or zippered on the line. The main set with or without microphone and can be retractable and or zippered as well. The exact specifications may vary.

Referring now more specifically to the drawings by numerals of reference, there is shown in FIGS. 1-7, various views of a personal listening apparatus 100.

Figure 1:
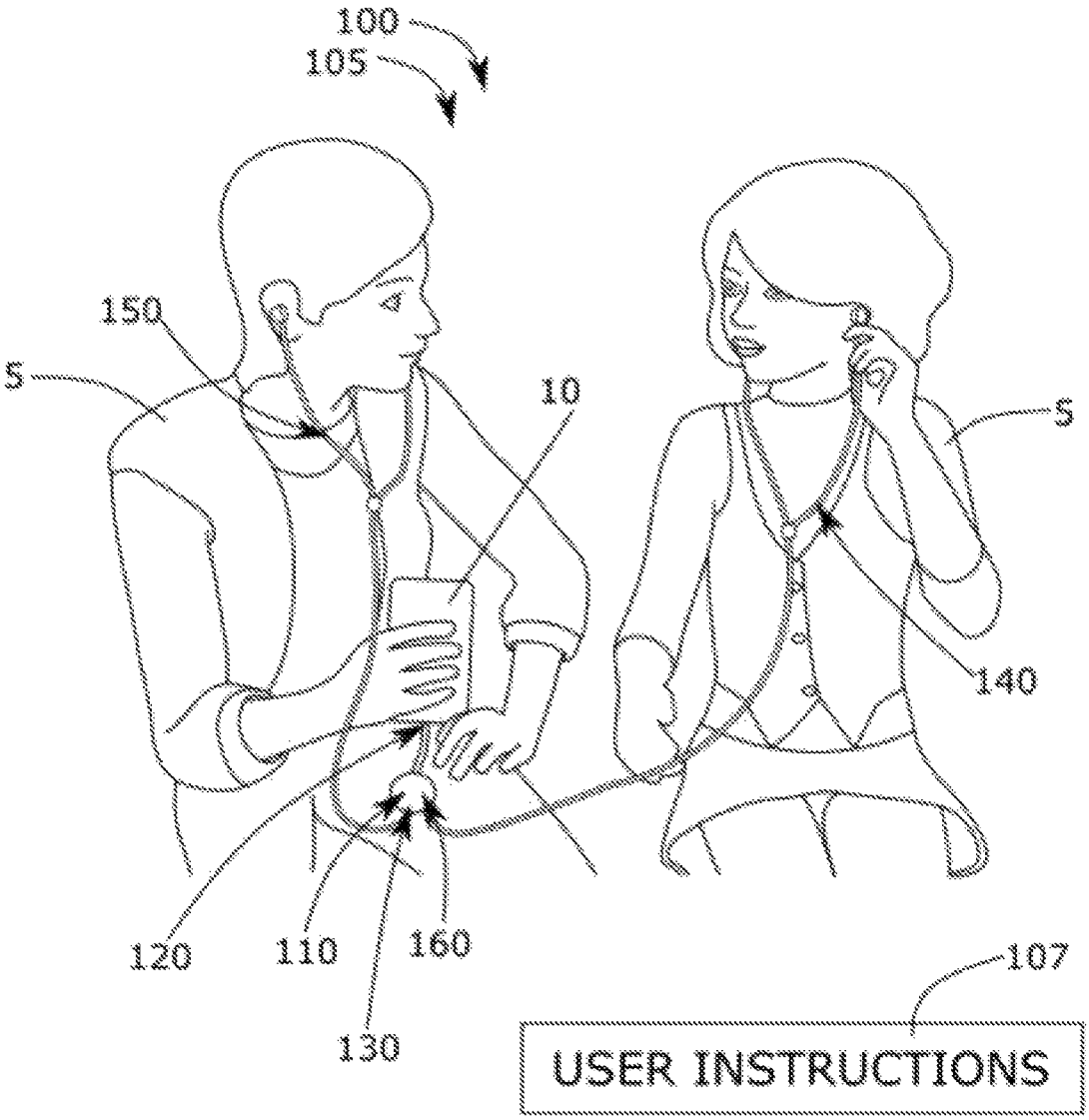
FIG. 1 is a perspective view of a personal listening apparatus during an 'in-use' condition, according to an embodiment of the disclosure.

FIG. 1 shows a personal listening apparatus 100 during an 'in-use' condition 150, according to an embodiment of the present disclosure. As illustrated, the personal listening apparatus 100 may include a housing 110, a main audio input 120, a splitter 130, a first headset 140, a second headset 150, and a first means for storing the first headset 160. As shown, the personal listening apparatus 100 may be used for a plurality of users 5 (shown here to be two users) to listen to an electronic device 10.

According to one embodiment, the personal listening apparatus 100 may be arranged as a kit 105. The kit 105 may include set of user instructions 107. The instructions 107 may detail functional relationships in relation to the structure of the personal listening apparatus 100 (such that the personal listening apparatus 100 can be used, maintained, or the like, in a preferred manner).

Figure 2:
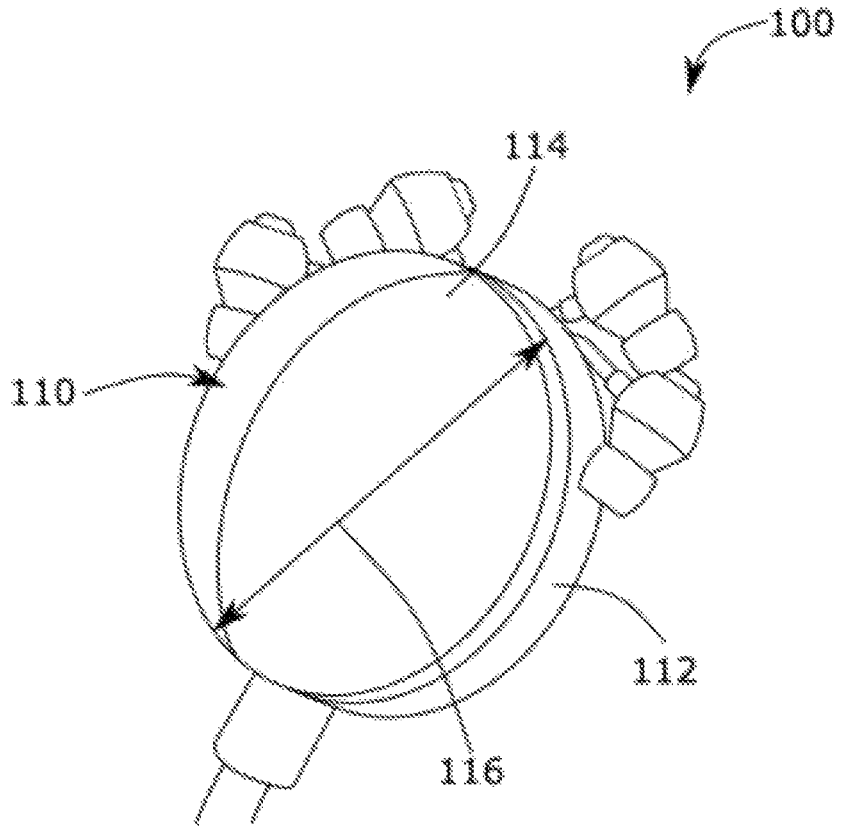
FIG. 2 is a cutaway, detail view of the personal listening apparatus of FIG. 1, according to an embodiment of the present disclosure.

FIG. 2 is a cutaway, detail view of the personal listening apparatus 100 of FIG. 1, according to an embodiment of the present disclosure. The housing 110 may include an outer-shell 112 that defines an inner-cavity 114. In one embodiment, the housing 110 may be made from a durable material such as plastic. However, other materials are contemplated.

Preferably, as shown, the housing 110 may be cylindrical or otherwise have a face that is substantially circular in shape. In this embodiment, the housing 110 (face) may have a circle diameter 116 of at least 2 inches. It should be appreciated that the housing 110 may have a circle diameter 116 of less than 2 inches or more than 2 inches. In other embodiments, the housing 110 may take different shapes other than circular. For example, in one embodiment the housing 110 may have a face that is substantially heart-shaped. Similarly, in another embodiment, the housing 110 may take the shape of an animal, such as a dog, cat, mouse, pig, etc.

Figure 3A:
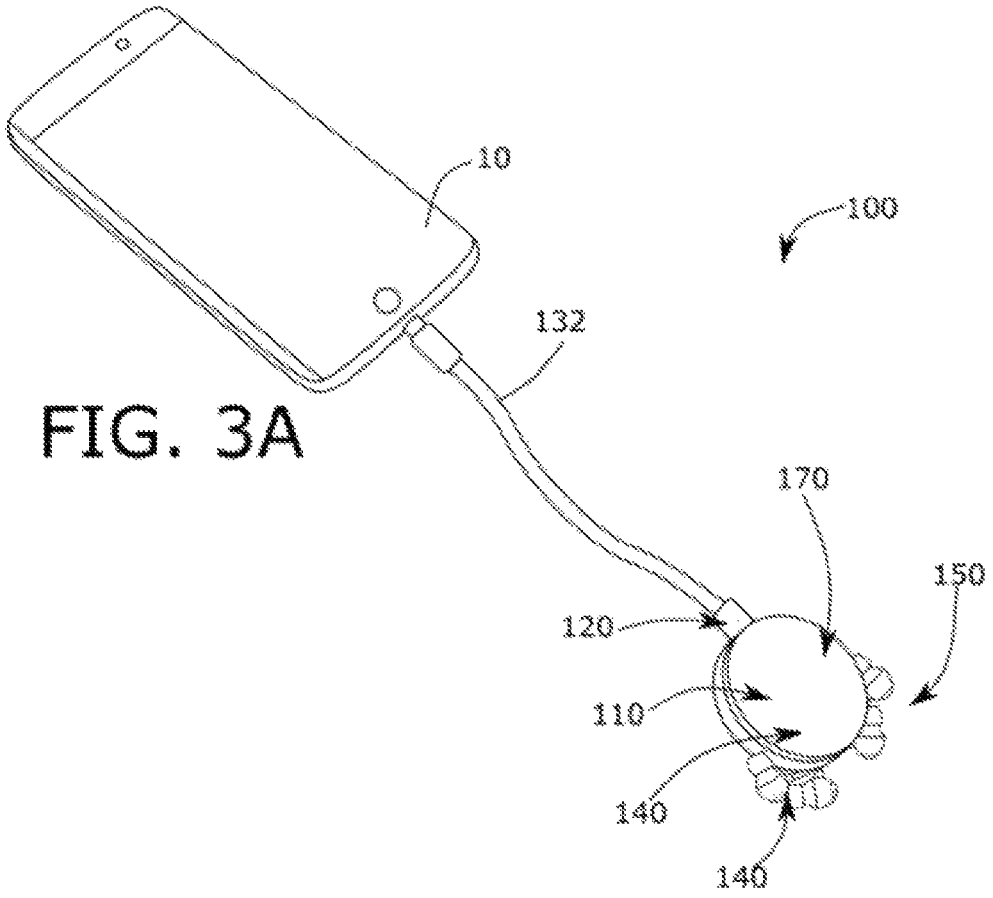
FIG. 3A is a perspective view of the personal listening apparatus of FIG. 1, according to an embodiment of the present disclosure.

FIG. 3A is a perspective view of the personal listening apparatus of FIG. 1, according to an embodiment of the present disclosure. As above, the personal listening apparatus 100 may include the housing 110, the main audio input 120, the splitter 130 (FIG. 4), the first headset 140, the second headset 150, and the first means for storing the first headset 160 (FIG. 1).

As shown, the main audio input 120 may be a wired connection further configured to electronically couple the electronic device 10 to the splitter 130. In particular, the main audio input 120 may be fixed to the housing 110 and configured to communicably couple with the electronic device 10 and receive an audio signal 122 (symbolically shown in FIG. 4) from the electronic device 10.

Figure 3B:
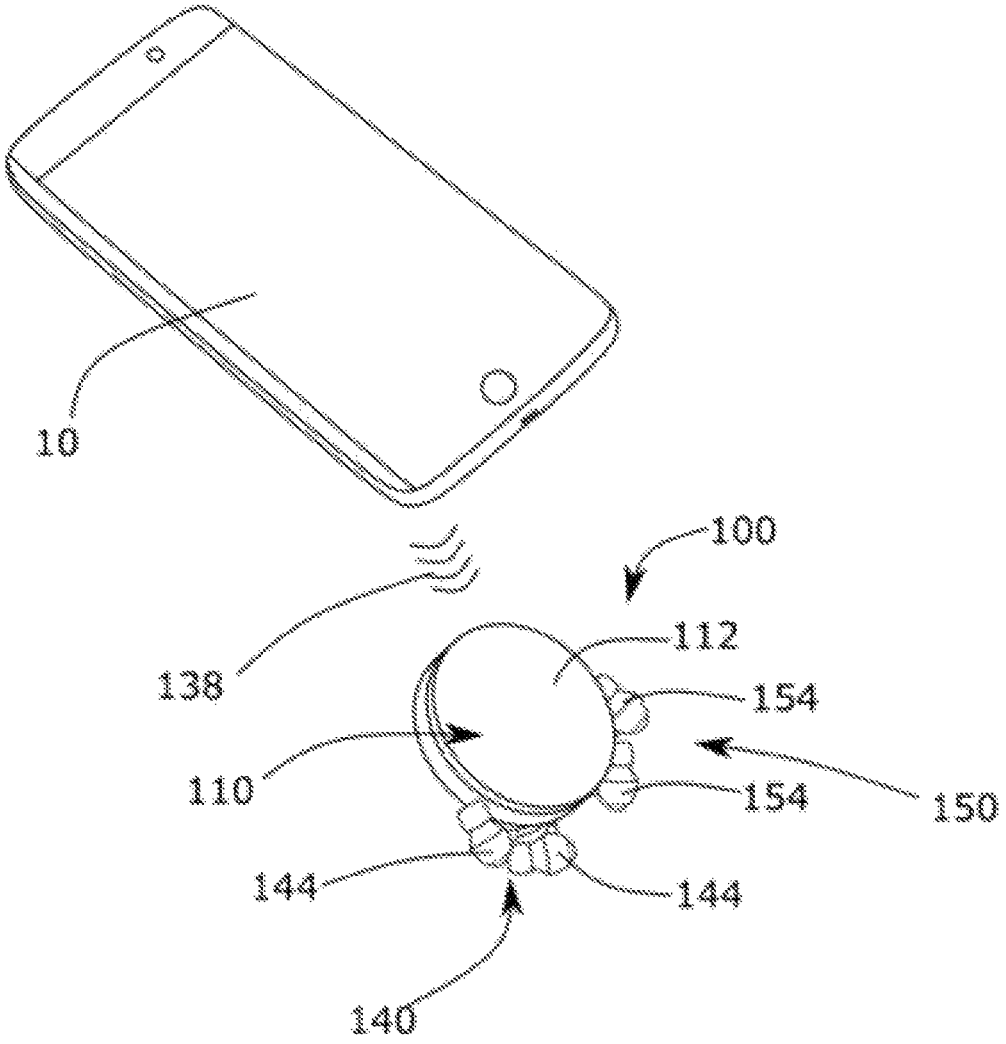
FIG. 3B is a perspective view of the personal listening apparatus of FIG. 1, according to another embodiment of the present disclosure.

FIG. 3B is a perspective view of the personal listening apparatus of FIG. 1, according to another embodiment of the present disclosure. Here, the first headset 140 and the second headset 150 are shown in a retracted state.

According to one embodiment, the main audio input 120 may configured to form a wirelessly couple 138 with the electronic device 10. In particular, the main audio input 120 may include a wireless communication radio (e.g., a conventional RF radio within the housing) configured to wirelessly couple the electronic device 10 to the splitter 130. Preferably, the wireless communication radio may be a Bluetooth radio.

Figure 4:
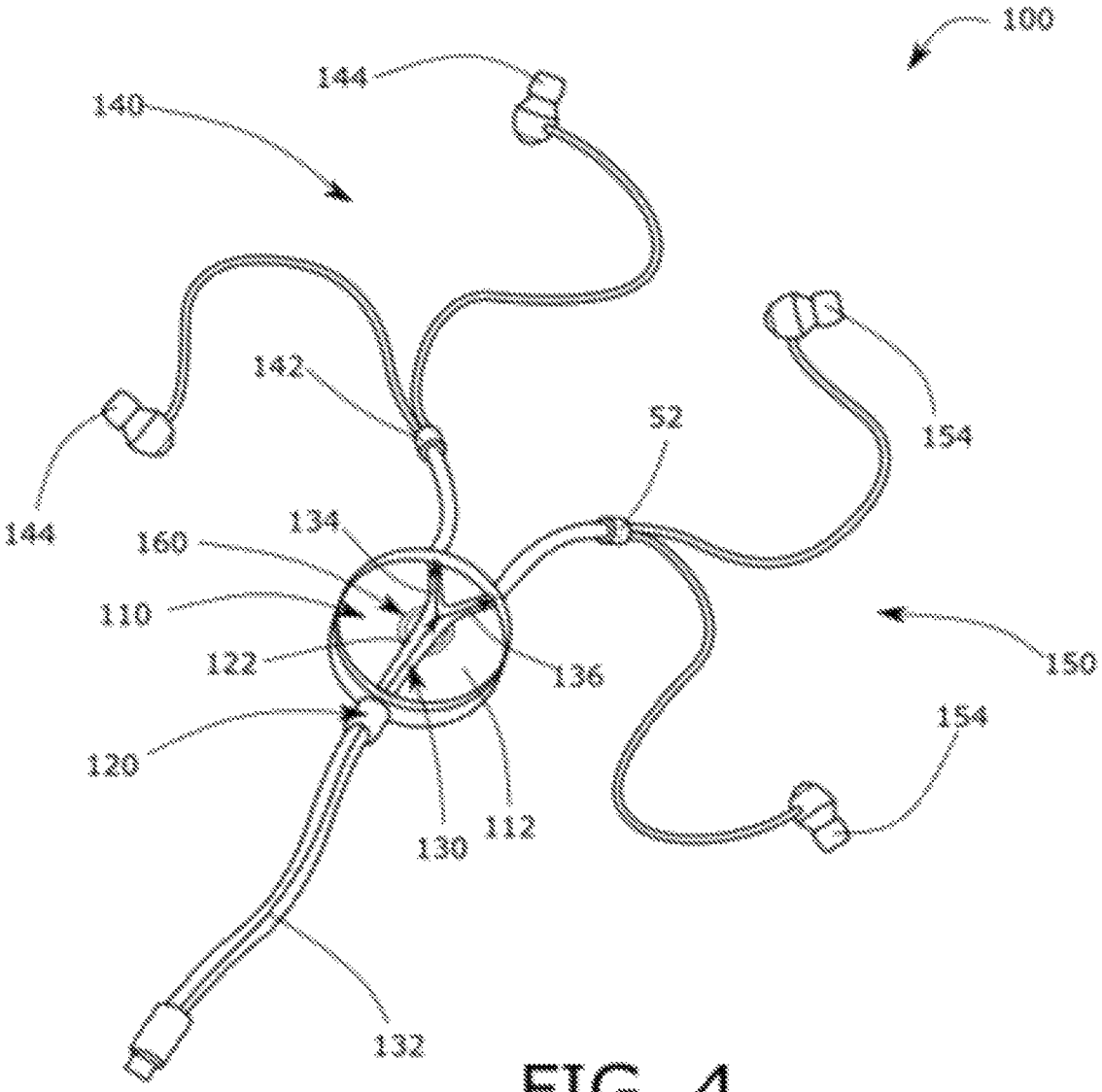
FIG. 4 is a cutaway view of the personal listening apparatus of FIG. 1, according to an embodiment of the present disclosure.

FIG. 4 is a cutaway view of the personal listening apparatus of FIG. 1, according to an embodiment of the present disclosure. Here, the first headset 140 and the second headset 150 are shown in a deployed or otherwise extended state. As above, the personal listening apparatus 100 may include the housing 110, the main audio input 120, the splitter 130, the first headset 140, the second headset 150, and the first means for storing the first headset 160 (here, configured to wind both the first headset 140 and the second headset 150 the first headset 140, the second headset 150 together).

As shown, the splitter 130 may be fixed to the housing 110 within the inner-cavity 114, and electronically coupled to the main line 132. The splitter 130 may be configured to receive the audio signal 122 (symbolically shown) from the main audio input 120 and split the audio signal 122 into a first audio output signal 134 (symbolically shown) and a second audio output signal 136 (symbolically shown).

Also as shown, the first headset 140 may include a first audio line 142 and a first pair of earphones 144. The first audio line 142 may be electronically coupled to the splitter 130, passing though the outer-shell 112, and configured to communicate the first audio output signal 134 to the first pair of earphones 144. The first pair of earphones 144 may be electronically coupled to the first audio line 142 and configured to convert the first audio output signal 134 into a corresponding first sound.

Similarly, the second headset 150 may include a second audio line 152 and a second pair of earphones 154. The second audio line 152 may be electronically coupled to the splitter 130, passing though the outer-shell 112, and configured to communicate the second audio output signal 136 to the second pair of earphones 154. The second pair of earphones 154 may be electronically coupled to the second audio line 152 and configured to convert the second audio output signal 136 into a corresponding second sound. Preferably, the first pair of earphones 144 may be a first pair of earbuds and the second pair of earphones 154 may be a second pair of earbuds.

Figure 5:
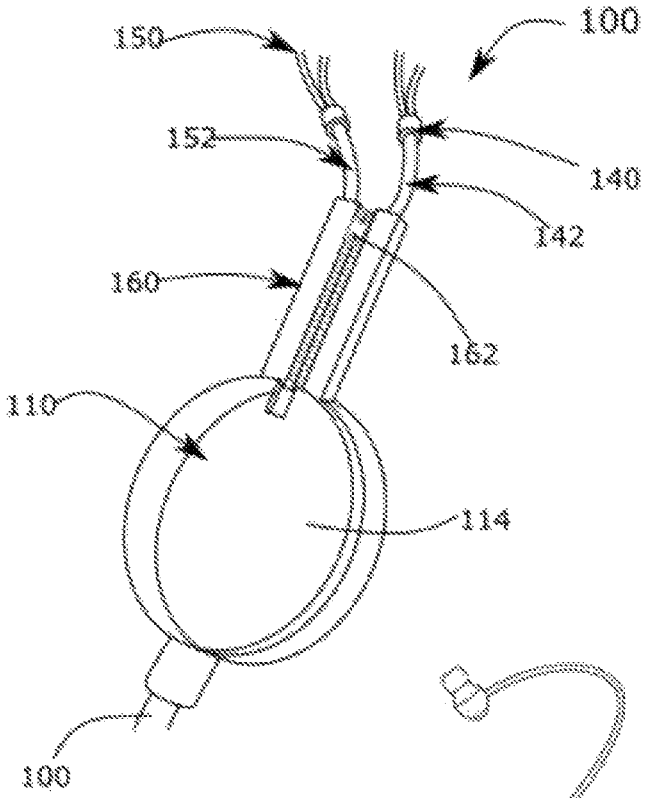
FIG. 5 is a detail view of the personal listening apparatus of FIG. 1, according to one embodiment of the present disclosure and in a first state.
Figure 6:
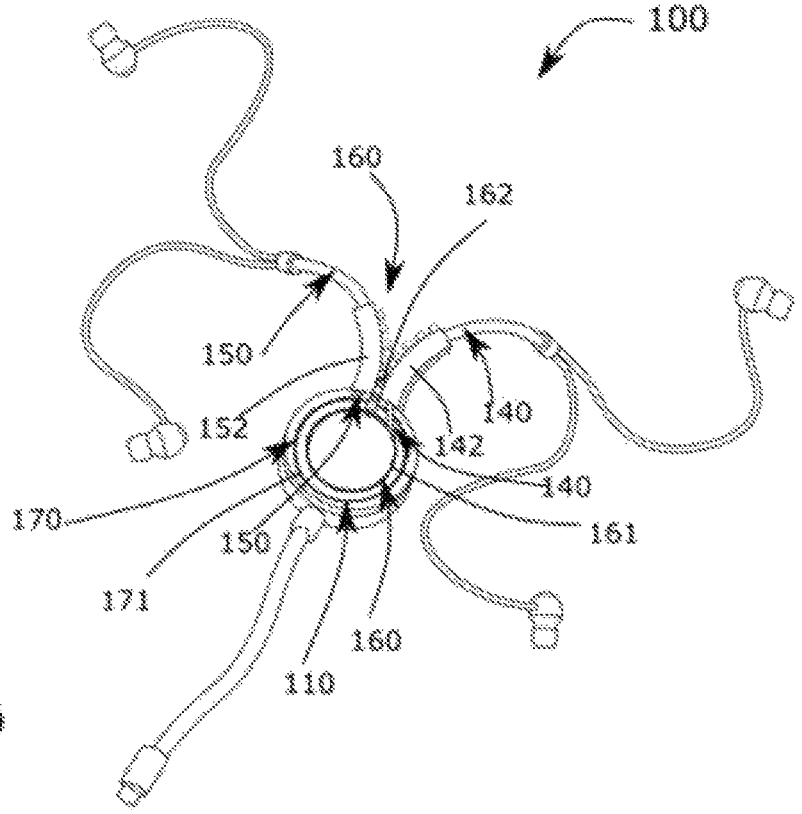
FIG. 6 is a perspective view of the personal listening apparatus of FIG. 5, in a second state.

FIGS. 5-6 are detail views of the personal listening apparatus of FIG. 1, according to one embodiment of the present disclosure and in a first state (i.e., coupled together or otherwise stowed). FIG. 6 is a perspective view of the personal listening apparatus of FIG. 5, in a second state (i.e., separated or otherwise deployed). As above, the personal listening apparatus 100 may include the housing 110, the main audio input 120, the splitter 130 (FIG. 4), the first headset 140, the second headset 150, and the first means for storing the first headset 160.

According to one embodiment, and as illustrated, the first means for storing the first headset 160 may be arranged as a conventional spring energized cable retractor configured to wind the wiring of the first headset 140 or otherwise stow its cables within the housing 110. Other conventional winding mechanisms are contemplated. In this way, the first headset 140 may remain retracted when only a single user is using the personal listening apparatus 100.

According to one embodiment, the personal listening apparatus 100 may further include a second means for stowing the second headset 170. Here, the second means 170 for stowing the second headset 150 is similarly arranged as a conventional spring energized cable retractor configured to wind the wiring of the second headset 150 or otherwise stow its cables within the housing 110. Other conventional winding mechanisms are contemplated. In this way, the second headset 150 may remain retracted or otherwise stowed when the personal listening apparatus 100 is not in use.

As shown, the first means for stowing the first headset 160 may include a fastener 162 independently coupled to each of the first audio line 142 of the first headset 140 and the second audio line 152 of the second headset 150. The first means for stowing the first headset 160 is configured to repeatedly couple and decouple the first audio line 142 to the second audio line 152, manually. Further, the first headset 140 may be stowed by coupling the first audio line 142 to the second audio line 152 via the fastener 162, thus substantially forming a single cable that extends from the housing 110.

It should be understood that, the first audio line 142 and the second audio line 152 are illustrated for convenience as having a short length, however, in practice, the first audio line 142 and the second audio line 152 (as well as the first means for stowing the first headset 160) may be substantially longer than illustrated. For example, according to one embodiment, the first means 160 for stowing the first headset 140 may be configured to couple the first audio line 142 to the second first audio line 142 along a length of at least 3 inches.

According to one embodiment, the first means for stowing the first headset 160 may further include a first headset channel through which the first audio line 142 passes, and a second headset channel through which the second audio line 152 passes. The first headset channel and the second headset channel may be configured to support the first headset 140 and the second headset 150 while each is repeatedly coupled and separated from each other via the fastener 162. Preferably, the fastener 162 may be a zipper. However, other fasteners 162 are contemplated.

As shown, the first means 160 for stowing the first headset 140 may include a first cable retractor 161 configured to windably retract the first audio line 142 of the first headset 140 into the inner-cavity 114 of the housing 110. In this embodiment, the first cable retractor 161 may include a fastener 163 configured to energize retraction of the first audio line 142 of the first headset 140 into the inner-cavity 114 of the housing 110. Further to this, the first cable retractor 161 may be configured to retract the first audio line 142 of the first headset 140 into the inner-cavity 114 of the housing 110, independently of the second audio line 152 of the second headset 150.

As shown, a second means 170 for stowing the second headset 150 may be provided. The second means 170 for stowing the second headset 150 may include a second cable retractor 171 configured to windably retract the second audio line 152 of the second headset 150 into the inner-cavity 114 of the housing 110. Similarly, to the first cable retractor 161, the second cable retractor 171 may be further configured to retract the second audio line 152 of the first headset 140 into the inner-cavity 114 of the housing 110, independently of the first audio line 142 of the first headset 140.

Figure 7:
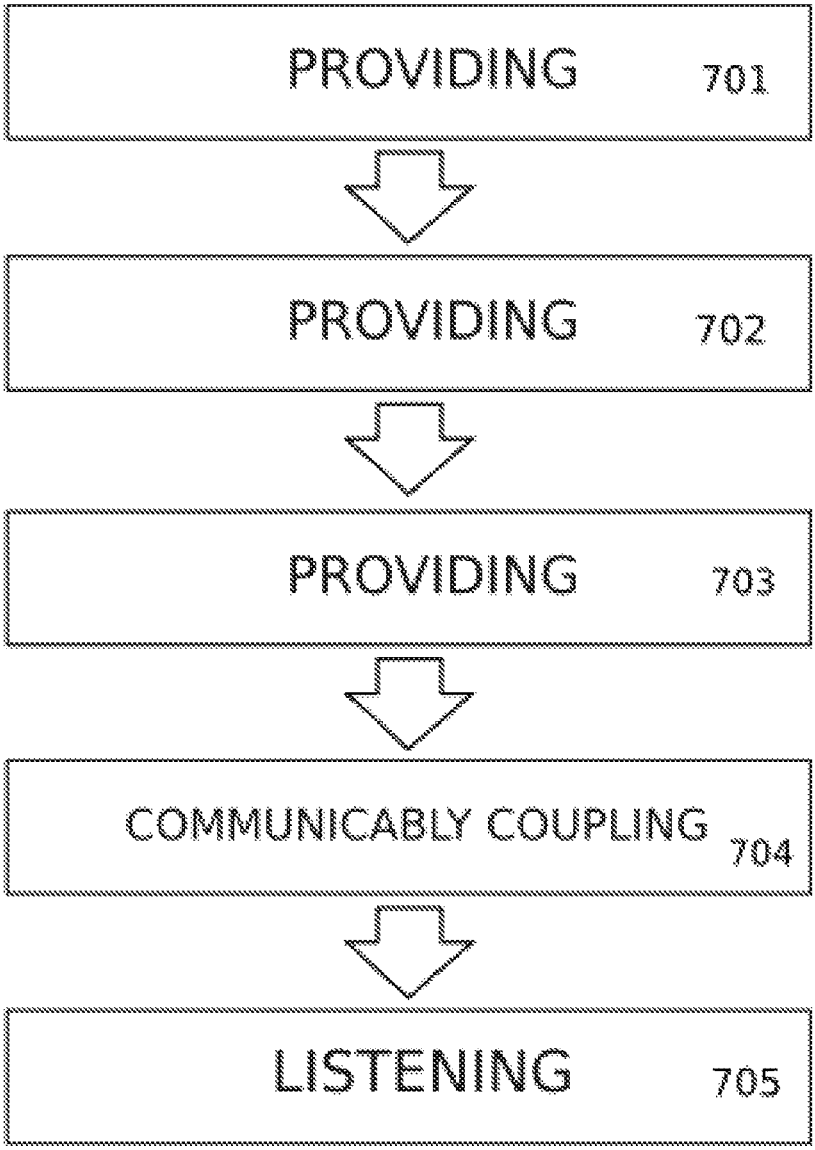
FIG. 7 is a flow diagram illustrating a method of use for personal listening apparatus, according to an embodiment of the present disclosure.

FIG. 7 is a flow diagram illustrating a method of using a personal listening apparatus 700, according to an embodiment of the present disclosure. As illustrated, the method of using a personal listening apparatus 700 may include the steps of: providing 701 the personal listening apparatus as above; providing by a first user, wearing 702 the first headset; by a second user, wearing 703 the second headset; communicably coupling 704 the main audio input with the electronic device; listening 705 to the first sound via the first headset; and listening to the second sound via the second headset.

It should be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for personal listening apparatus 100 (e.g., different step orders within above-mentioned list, elimination or addition of certain steps, including or excluding certain maintenance steps, etc.), are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A personal listening apparatus for a plurality of users to listen to an electronic device, the personal listening apparatus comprising:

a housing including an outer-shell that defines an inner-cavity;

a main audio input fixed to the housing, and configured to communicably couple with the electronic device and receive an audio signal from the electronic device;

a splitter fixed to the housing within the inner-cavity, and electronically coupled to the main line, the splitter configured to receive the audio signal from the main audio input and split the audio signal into a first audio output signal and a second audio output signal;

a first headset including a first audio line and a first pair of earphones, the first audio line electronically coupled to the splitter, passing though the outer-shell, and configured to communicate the first audio output signal, the first pair of earphones electronically coupled to the first audio line and configured to convert the first audio output signal into a corresponding first sound;

a second headset including a second audio line and a second pair of earphones, the second audio line electronically coupled to the splitter, passing though the outer-shell, and configured to communicate the second audio output signal, the second pair of earphones electronically coupled to the second audio line and configured to convert the second audio output signal into a corresponding second sound; and a first means for stowing the first headset.

2. The personal listening apparatus of claim 1, wherein the first means for stowing the first headset includes a fastener independently coupled to each of the first audio line of the first headset and the second first audio line of the second headset, and configured to repeatedly couple and decouple the first audio line to the second audio line, manually; and wherein the first headset is stowed by coupling the first audio line to the second audio line via the fastener.

3. The personal listening apparatus of claim 2, wherein the first means for stowing the first headset further includes a first headset channel through which the first audio line passes a second headset channel through which the second audio line passes, the first headset channel repeatedly coupleable to and separable from the second headset channel via the fastener.

4. The personal listening apparatus of claim 3, wherein the fastener is a zipper.

5. The personal listening apparatus of claim 4, wherein the first means for stowing the first headset is configured to couple the first audio line to the second first audio line along a length of at least 3 inches.

6. The personal listening apparatus of claim 1, wherein the first means for stowing the first headset includes a first cable retractor configured to windably retract the first audio line of the first headset into the inner-cavity of the housing.

7. The personal listening apparatus of claim 6, wherein the first cable retractor includes a spring configured to energize retraction of the first audio line of the first headset into the inner-cavity of the housing.

8. The personal listening apparatus of claim 6, wherein the first cable retractor is further configured to retract the first audio line of the first headset into the inner-cavity of the housing, independently of the second audio line of the second headset.

9. The personal listening apparatus of claim 8, further comprising a second means for stowing the second headset (170), said second means for stowing the second headset including a second cable retractor configured to windably retract the second audio line of the second headset into the inner-cavity of the housing.

10. The personal listening apparatus of claim 9, wherein the second cable retractor is further configured to retract the second audio line of the first headset into the inner-cavity of the housing, independently of the first audio line of the first headset.

11. The personal listening apparatus of claim 8, wherein the housing is substantially circular in shape.

12. The personal listening apparatus of claim 11, wherein the housing has a circle diameter of at least 2 inches.

13. The personal listening apparatus of claim 6, wherein the housing is substantially heart-shaped.

14. The personal listening apparatus of claim 1, wherein the first headset is a first pair of earbuds; and wherein the second headset is a second pair of earbuds.

15. The personal listening apparatus of claim 1, wherein the main audio input is a wired connection further configured to electronically couple the electronic device to the splitter.

16. The personal listening apparatus of claim 1, wherein the main audio input includes a wireless communication radio configured to wirelessly couple the electronic device to the splitter.

17. The personal listening apparatus of claim 16, wherein the wireless communication radio is a Bluetooth radio.

18. A personal listening apparatus for a plurality of users to listen to an electronic device, the personal listening apparatus comprising:

a housing including an outer-shell that defines an inner-cavity;

a main audio input fixed to the housing, and configured to communicably couple with the electronic device and receive an audio signal from the electronic device;

a splitter fixed to the housing within the inner-cavity, and electronically coupled to the main line, the splitter configured to receive the audio signal from the main audio input and split the audio signal into a first audio output signal and a second audio output signal a first headset including a first audio line and a first pair of earphones, the first audio line electronically coupled to the splitter, passing though the outer-shell, and configured to communicate the first audio output signal, the first pair of earphones electronically coupled to the first audio line and configured to convert the first audio output signal into a corresponding first sound;

a second headset including a second audio line and a second pair of earphones, the second audio line electronically coupled to the splitter, passing though the outer-shell, and configured to communicate the second audio output signal, the second pair of earphones electronically coupled to the second audio line and configured to convert the second audio output signal into a corresponding second sound;

a first means for stowing the first headset; and a second means for stowing the second headset, said second means for stowing the second headset including a second cable retractor configured to windably retract the second audio line of the second headset into the inner-cavity of the housing; and wherein the first means for stowing the first headset includes a fastener independently coupled to each of the first audio line of the first headset and the second first audio line of the second headset, and configured to repeatedly couple and decouple the first audio line to the second audio line, manually; and wherein the first headset is stowed by coupling the first audio line to the second audio line via the fastener;

wherein the first means for stowing the first headset further includes a first headset channel through which the first audio line passes a second headset channel through which the second audio line passes, the first headset channel repeatedly coupleable to and separable from the second headset channel via the fastener;

wherein the fastener is a zipper;

wherein the first means for stowing the first headset is configured to couple the first audio line to the second first audio line along a length of at least 3 inches;

wherein the first means for stowing the first headset includes a first cable retractor configured to windably retract the first audio line of the first headset into the inner-cavity of the housing;

wherein the first cable retractor includes a spring configured to energize retraction of the first audio line of the first headset into the inner-cavity of the housing;

wherein the first cable retractor is further configured to retract the first audio line of the first headset into the inner-cavity of the housing, independently of the second audio line of the second headset;

wherein the housing is substantially circular in shape;

wherein the housing has a circle diameter of at least 2 inches;

wherein the first headset is a first pair of earbuds; and wherein the second headset is a second pair of earbuds.

19. The personal listening apparatus of claim 18, further comprising set of instructions; and wherein the personal listening apparatus is arranged as a kit.

20. A method for a plurality of users to listen to an electronic device, the method comprising the steps of:

providing a personal listening apparatus including:

a housing including an outer-shell that defines an inner-cavity, a main audio input fixed to the housing, and configured to communicably couple with the electronic device and receive an audio signal from the electronic device, a splitter fixed to the housing within the inner-cavity, and electronically coupled to the main line, the splitter configured to receive the audio signal from the main audio input and split the audio signal into a first audio output signal and a second audio output signal, a first headset including a first audio line and a first pair of earphones, the first audio line electronically coupled to the splitter, passing though the outer-shell, and configured to communicate the first audio output signal, the first pair of earphones electronically coupled to the first audio line and configured to convert the first audio output signal into a corresponding first sound, a second headset including a second audio line and a second pair of earphones, the second audio line electronically coupled to the splitter, passing though the outer-shell, and configured to communicate the second audio output signal, the second pair of earphones electronically coupled to the second audio line and configured to convert the second audio output signal into a corresponding second sound, and a first means for stowing the first headset;

by a first user, wearing the first headset;

by a second user, wearing the second headset;

communicably coupling the main audio input with the electronic device;

listening to the first sound via the first headset; and listening to the second sound via the second headset.

* * * * *